United States Patent [19]

Tamura

[11] 4,196,685

[45] Apr. 8, 1980

[54] THREAD ABNORMALITY DETECTION UTILIZING INTEGRATOR AND COMPARATOR IN CONJUNCTION WITH ROTARY THREAD TENSION DISK

[75] Inventor: Kazuyoshi Tamura, Hekinan, Japan

[73] Assignee: Aisin Seiki Kabushiki Kaisha, Kariya, Japan

[21] Appl. No.: 924,322

[22] Filed: Jul. 13, 1978

[30] Foreign Application Priority Data

Jul. 25, 1977 [JP] Japan ..... 52-99247[U]

[51] Int. Cl.[2] ..... D05B 69/36

[52] U.S. Cl. ..... 112/273; 112/278

[58] Field of Search ..... 112/273, 278, 275, 277, 112/158 E

[56] References Cited

U.S. PATENT DOCUMENTS

| | | | |
|---|---|---|---|
| 3,352,267 | 11/1967 | Brandriff et al. | 112/278 |
| 3,843,883 | 10/1974 | De Vita et al. | 112/273 X |
| 3,881,435 | 5/1975 | Makabe | 112/275 |
| 4,052,946 | 10/1977 | Rydz et al. | 112/158 E |

FOREIGN PATENT DOCUMENTS

| | | | |
|---|---|---|---|
| 934843 | 10/1973 | Canada | 112/273 |

*Primary Examiner*—Peter P. Nerbun

*Attorney, Agent, or Firm*—Sughrue, Rothwell, Mion, Zinn and Macpeak

[57] ABSTRACT

A drive control system for stopping a sewing machine when a thread of the sewing machine is broken or tangled. The system comprises rotational speed meter circuits, each one of which is coupled with respective thread tension disk means which rotate in synchronism due to movement of threads on them. A deceleration of the rotation of one of the thread tension disk means is detected by a rotational speed meter circuit coupled with it. An electric logic circuit in the system, which is energized to drive the sewing machine in response to a closure of a start switch and deenergized to stop the sewing machine in response to a closure of a stop switch, is deenergized to stop the sewing machine in response to the detection of the deceleration of the rotation of one of the rotary disks.

6 Claims, 5 Drawing Figures

THREAD ABNORMALITY DETECTION UTILIZING INTEGRATOR AND COMPARATOR IN CONJUNCTION WITH ROTARY THREAD TENSION DISK

BACKGROUND OF THE INVENTION

The invention relates to a drive control system for a sewing machine. More specifically, it relates to a system for stopping automatically a sewing machine when a thread of the machine is tangled or broken.

Most common industrial and household sewing machines in use today were equipped with drive control systems having a foot controller. The foot controller comprises a switch contact and a variable resistor having a resistor and a slider. The slider normally touches the switch contact and moves along the resistor in correspondence with downward force on the foot controller by an operator. The sewing machine is at standstill when the slider touches the switch contact and begins to move when the slider touches an open terminal of the resistor by the downward force on the foot controller. The sewing speed is accelerated with the advance of the movement of the slider toward the other terminal of the resistor by increasing the downward force. Decreasing the downward force, the slider moves toward the switch contact and the sewing speed is decelerated, then the sewing machine stops when the slider touches the switch contact. Therefore, it takes a relatively long time to stop the sewing machine after an accidental skip of sewing stitches, a tangle of a cloth on the sewing machine, or a break, consumption or tangle of an upper or lower sewing thread. Because the detection of the accidents by the operator is sometimes tardy the release of the downward force from the foot controller is delayed after the accident. However, it is desirable to stop the sewing machine as fast as possible after an occurrence of the accidents of the sewing threads or the cloth.

SUMMARY OF THE INVENTION

It is therefore an object of the invention to provide a drive control system which stops automatically a sewing machine immediately after the occurrence of the accidents of the sewing threads or the cloth.

It is another object of the invention to provide a drive control system which supervise the movement of a plurality of sewing threads and stops a sewing machine at an abnormal condition of the threads.

Still another object of the invention is to provide a drive control system which is applicable for supervising not only the movement of a sewing thread but also a plurality of sewing threads and stops automatically a sewing machine at an abnormal condition of the movement.

A further object of the invention is to provide an improved drive control system which is compatible with the drive control of a sewing machine having a foot controller and stops automatically the sewing machine immediately after the occurrence of the accidents of the sewing threads or the cloth.

According to the invention, the drive control system comprises one or more converters which are coupled with thread tension disk units of a sewing machine to convert the rotation of the disk units into an oscillating electric signal; one or more speed meter circuits which detect a decrease of the rotational speed of the disk units by supervising the oscillating electric signal; and an electric logic circuit which is energized to generate a drive indication signal in response to a closure of a start switch and deenergized in response to a closure of a stop switch and detection of the falling down of the rotational speed. In one embodiment of the invention, the converters include respectively a magnet gear and a flux sensor such as hall element, induction coil and magnetic head. Input and output terminals of the converters are arranged in the form of a plug, and input terminals of the speed meter circuits are arranged in the form of a plug socket so as to connect the converters with the speed meter circuits in a detachable mode. The speed meter circuits include respectively a shaping and amplifying circuit for shaping the oscillating electric signal from the converters into a train of pulses, a monostable multivibrator for generating pulses of a constant pulse width in synchronism with the pulses from the shaping and amplifying circuits, an integrating circuit which integrates the pulses from the monostable multivibrator, a comparator which compares the output voltage of the integrating circuit with a reference voltage and generates a meaningful signal (low level "0") when the former falls below the latter, and a logical "or" element, connected between the output terminal of the monostable multivibrator and the input terminal of the integrating circuit, which passes the output pulses of the multivibrator and supplies the integrating circuit with a voltage enough to prevent the generation of the meaningful signal at the output terminal of the comparator when the converters are disconnected from the speed meter circuit. The electric logic circuit includes a logical "and" element to which the output of the speed meter circuits are applied, a monostable multivibrator which generates a pulse when the output of the logical "and" element falls to the low level "0", a first logical circuit which is energized to generate a basic drive indication signal by a closure of a start switch and deenergized by a closure of a stop switch or the pulse from the monostable multivibrator in the electric logic circuit, a delay circuit which provides the basic drive indication signal with a delay, and a second logical circuit which generates the drive indication signal suitable for an actual drive control of the sewing machine in response to the basic drive indication signal, the output of the logical "and" element and the output of the delay circuit. The drive indication signal energizes a solenoid energization circuit which controls connection of a motor clutch of the sewing machine.

DESCRIPTION OF PREFERRED EMBODIMENT

Figure 1:
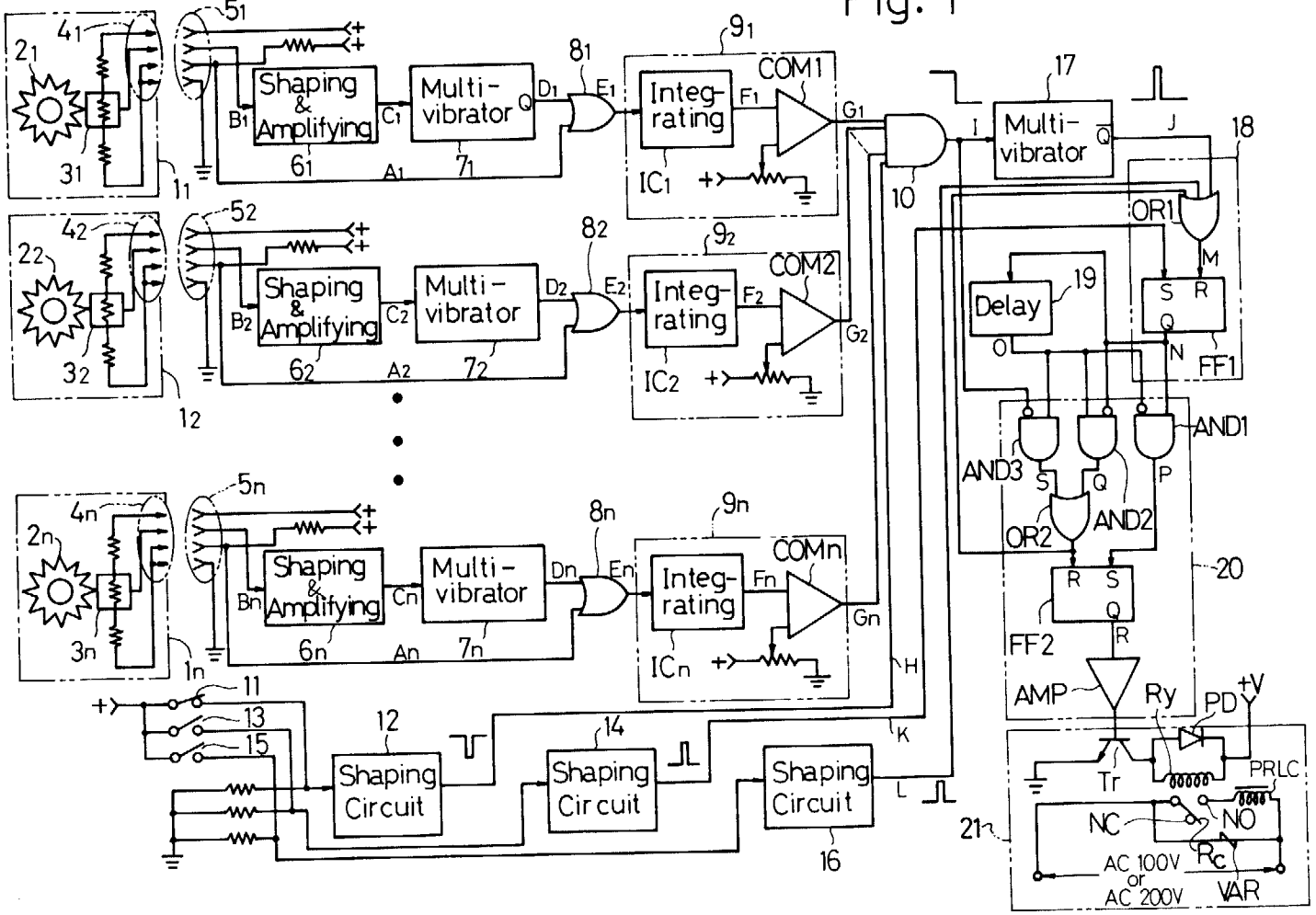
FIG. 1 is a block diagram of one embodiment of the invention.

Referring to FIG. 1 of the drawings, $1_1$ through $1_n$ indicate converters, each one of which is assigned for each one of the thread tension disk units of a sewing machine. The converters $1_1$ through $1_n$ respectively have a magnet gear $2_1$ through $2_n$ a flux sensor $3_1$ through $3_n$ and plug terminals $4_1$ through $4_n$ which are arranged to connect with socket terminals $5_1$ through $5_n$ of speed sensor circuits, which respectively comprise a shaping and amplifying circuit $6_1$ through $6_n$, a monostable multivibrator $7_1$ through $7_1$ through $7_n$, a logical "or" element $8_1$ through $8_n$ and a level detection circuit $9_1$ through $9_n$. An oscillating voltage is generated at the flux sensors $3_1$ through $3_n$ by rotating the magnet gears $2_1$ through $2_n$ respectively. The level detection circuits $9_1$ through $9_n$ of the speed meter circuits respectively have an integrating circuit $IC_1$ through $IC_n$ and a comparator $COM_1$ through $COM_n$. A logical "and" element 10, a monostable multivibrator 17, a first logical circuit 18, a delay circuit 19 and a second logical circuit 18 construct an electric logic circuit. 11 indicates a normally closed contact which will be opened in a moment after termination of sewing (e.g. a sewing of a predetermined pattern). 13 indicates a normally open contact of a start switch. 15 indicates a normally open contact of a stop switch. A shaping circuit 12 absorbs a chattering noise and supplies out a well shaped pulse as a finish indication signal when contact 11 is closed in a moment. A shaping circuit 14 absorbs a chattering noise and supplies out a well shaped pulse as a start indication signal when contact 13 is closed in a moment. Shaping circuit 16 absorbs a chattering noise and supplies out a well shaped pulse as a stop indication signal when contact 15 is closed in a moment. The output pulse from shaping circuit 12 and output voltage of comparators $COM_1$ through $COM_n$ are supplied to logical "and" element 10 of the electric logic circuit. The first logical circuit 18 of the electric logic circuit comprises a logical "or" element $OR_1$, to which the output pulses from shaping circuit 16 and multivibrator 17 as well as an output of a logical "or" element $OR_2$ of second logical circuit 20 are supplied; and a flip-flop $FF_1$ which is set at the rising up of the output pulse of shaping circuit 14 and reset at the rising up of the output of logical "or" element $OR_1$. An output voltage (high level "1" at set condition) at an output terminal Q of flip-flop FF1 is applied to delay circuit 19 and second logical circuit 20. Delay circuit 19 supplies a delayed signal having delay time Td with respect to the output at terminal Q of flip-flop FF1 with second logical circuit 20. Second logical circuit 20 of the electric logic circuit comprises logical "and" elements AND1 through AND3, the logical "or" element OR2, a flip-flop FF2 and an amplifier AMP. The output at terminal Q of flip-flop FF2 and the output of delay circuit 19 are respectively applied at a non-inverting input terminal and an inverting input terminal of "and" element AND1, whereas they are respectively applied at an inverting input terminal and a non-inverting input terminal of "and" element AND2. The outputs of delay circuit 19 and "and" element 10 are respectively applied to a non-inverting and an inverting input terminals of "and". element AND3. Flip-flop FF2 is set at the increase of the output of element AND1 and reset at the increase of the output of element AND2 or AND3 through "or". element OR2. An output voltage (high level "1" at set condition) at an output terminal Q of flip-flop FF2 is applied to amplifier AMP, the output of which in turn is applied to a solenoid energization circuit 21. Solenoid energization circuit 21 comprises a switching transistor Tr of NPN type serially connected with a relay coil Ry; a diode connected across relay coil Ry for absorbing a reversal induced voltage across relay coil Ry at an energization of the coil Ry; and a normally open contact Rc which closes in response to the energization of relay coil Ry and connects a motor clutch solenoid RPLC to a power source.

Figure 2:
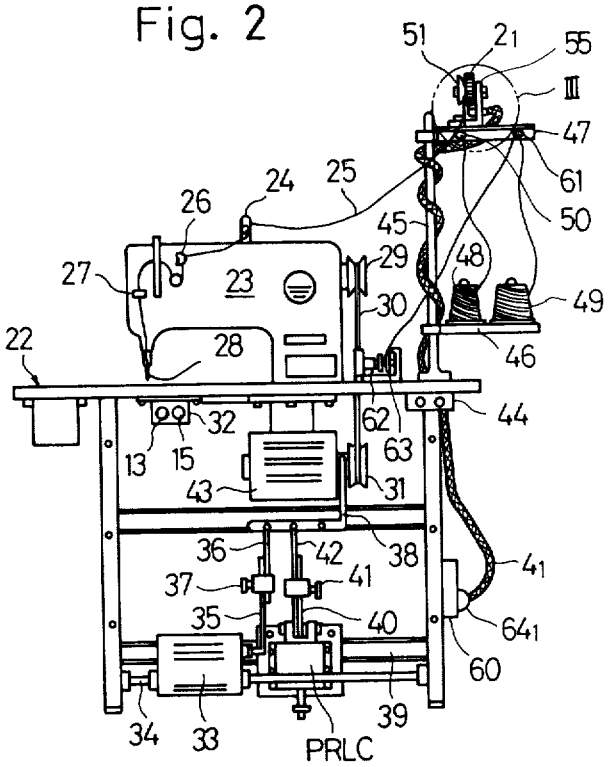
FIG. 2 is a front view of a sewing machine equipped with the drive control system of the invention.
Figure 3:
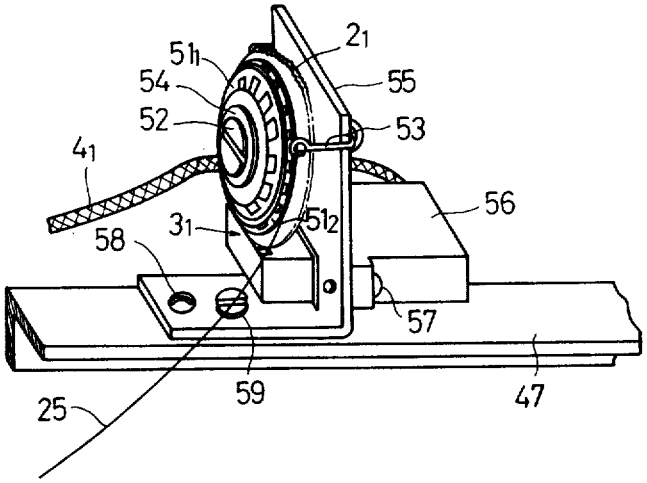
FIG. 3 is an enlarged perspective view of a part of the sewing machine shown in FIG. 2.

FIG. 2 shows a sewing machine having the drive control system shown in FIG. 1. FIG. 3 shows in enlarged scale a perspective view of a portion shown by a phantom line III. Referring to FIG. 2 and FIG. 3, 22 indicates a work supporting table on which a machine body 23 is fixed. 24 indicates a thread guide bar having an aperture through which an upper thread 25 passes. The upper thread 25 in turn passes through a thread tension guide 26, a thread guide 27 and an aperture of a sewing needle 28. A drive pulley 29 and a motor pulley 31 are connected with an endless belt 30. A switch box 32 having a start switch 13 and a stop switch 15 is fixed on table 22. A pedal 33 is rotatably connected with an axle 34 which in turn fixed to legs of table 22. A linking bar 35 is connected to a side of pedal 33. An adjustable joint 37 connects linking bar 35 with a linking bar 36 which engages with a motor lever 38. The solenoid PRLC is fixed on a plate 39 which is connected to the legs of table 22. A plunger associated with solenoid PRLC is connected with a linking bar 40 which in turn connected with a linking bar 40 by an adjustable joint 41. The linking bar 40 engages with the motor lever 38. The motor lever 38 rotates in counterclockwise direction when pedal 33 is forced down or solenoid PRLC is energized. The motor lever 38 connects a clutch motor 43 with motor pulley 31 when it rotates in counterclockwise direction. 44 indicates a power source device having a power switch. A standard 45 rises from table 22. The standard 45 sustains a bar 46 for sustaining an upper thread bundle 48 and a lower thread bundle 49, and a thread guide frame 47 having a projection 58. An angled plate 55 is fixed on thread guide frame 47 by a screw 59. The projection 58 of thread guide frame 47 engages with an aperture of angled plate 55. A box 56 is fixed on angled plate 55 by screws 57. An end of an axle is rotatably sustained by angle plate 55. The magnet gear $2_1$ and a pair of thread tension disks $51_1$ and $51_2$ are connected with the axle. The thread tension disks $51_1$ and $51_2$ are resilient metal plates. The disk $51_1$ is depressed toward the disk $5_2$ by a washer 54 and a screw 52. The upper thread 25 untied from thread bundle 48 passes through an aperture of a thread guide 53, the groove between the disks $51_1$ and $51_2$, the aperture of thread guide bar 24, thread tension guide 26 and the aperture of sewing needle 28. Therefore the disks $51_1$, $51_2$ and magnet gear $2_1$ are driven to rotate by the upper thread 25 during a sewing operation of sewing needle 28. Flux sensor $3_1$ and resistors (refer to FIG. 1) are in the box 56. Plug terminals $4_1$ are assembled in a plug $64_1$ which engages with a socket on a control box 60. The speed meter circuit, the electric logic circuit and solenoid energization circuit 21 (except the solenoid PRLC) shown in FIG. 1 are in the control box 60. The lower thread untied from thread bundle 49 passes through an aperture 61 of thread guide frame 47 and guided to a thread winder 62 which winds the lower thread on a lower thread bobbin 63.

The sewing machine shown in FIG. 1 has a thread tension disk unit including a pair of disks $51_1$ and $51_2$. Therefore the converters $2_2$ through $2_n$ and the speed meter circuits corresponding the converters $2_2$ through $2_n$ may be eliminated. However, operation of the system shown in FIG. 1 does not depend on the number of the converters and the speed meter circuits. Therefore the operation of the system shown in FIG. 1 is described hereinafter assuming that the sewing machine shown in FIG. 2 has a plurality of thread tension disk units, each one of which includes a pair of thread tension disks such as shown by $51_1$ and $51_2$.

Figure 4:
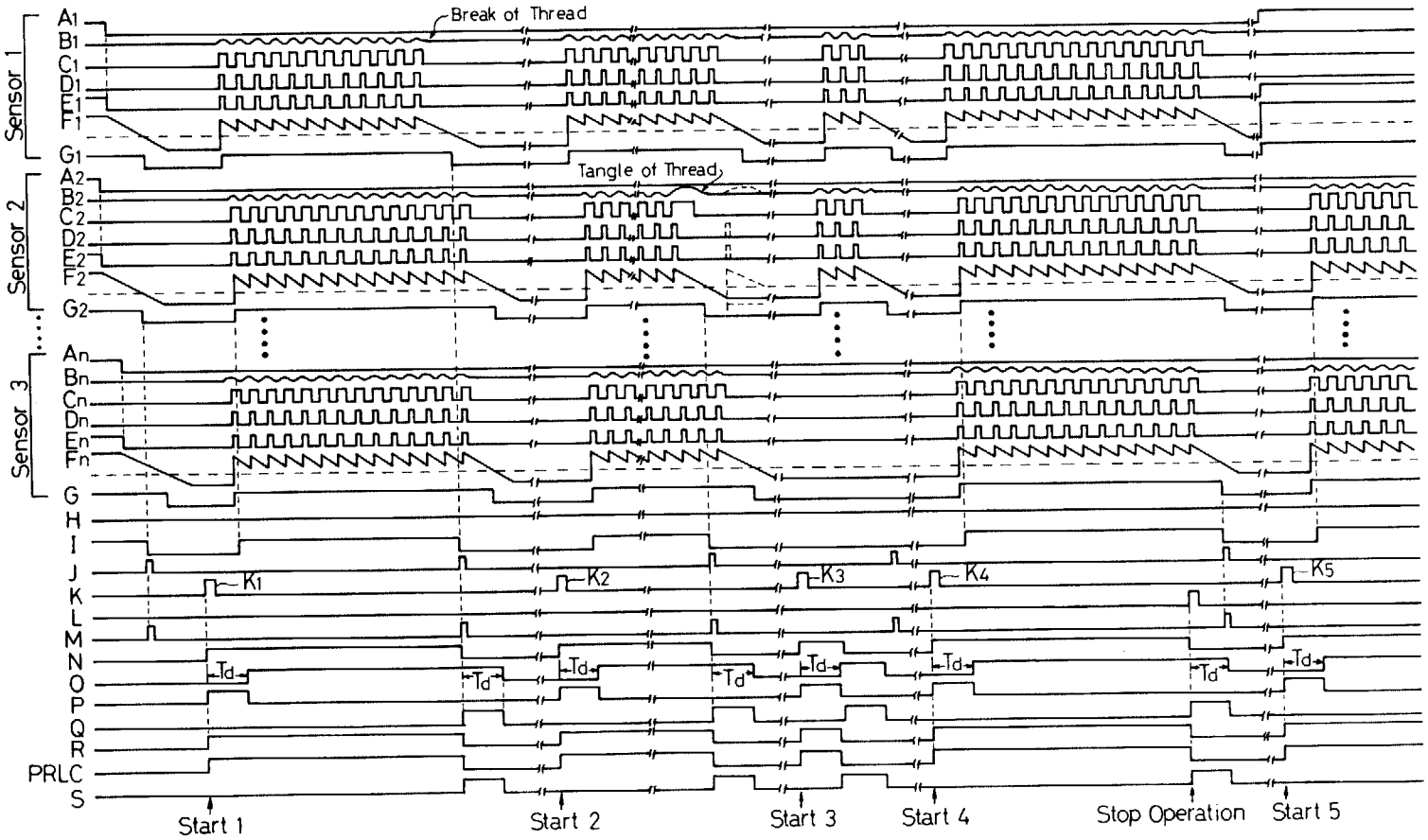
FIG. 4 graphically shows output voltage levels of some elements shown in FIG. 1.

Referring again to FIG. 1, $A_1$ through An, $B_1$ through $B_n$, $C_1$ through $C_n$, $D_1$ through $D_n$, $F_1$ through $F_n$, $G_1$ through $G_n$ and H through S indicate outputs of several elements in FIG. 1, which are shown in FIG. 4. $A_1$ through $A_n$ are positive high level "1" when plugs $4_1$ through $4_n$ of converters $1_1$ through $1_n$ are disconnected from socket $5_1$ through $5_n$ of speed meter circuits. $A_1$ through $A_n$ are low level "0" at the condition that the plugs $4_1$ through $4_n$ are connected with sockets $5_1$ through $5_n$.

Assuming that plugs $4_1$ through $4_n$ are connected with socket $5_1$ through $5_n$, outputs $B_1$ through $B_n$ of converters $1_1$ through $1_n$ do not oscillate when the sewing machine is at standstill. Therefore multivibrators $7_1$ through $7_n$ do not generate pulse and outputs $G_1$ through $G_n$ of comparators COM1 through $COM_n$ are low level "0". Thus output I of "and" element 10 is low level "0" although output H of shaping circuit 12 is high level "1". Flip-flops FF1 and FF2 are at reset condition. Thus output of amplifier AMP is low level "0" not enough to turn transistor Tr ON. When contact 13 of the start switch is closed in a moment (start 1 in FIG. 4), shaping circuit 14 generates a pulse $K_1$ which sets flip-flop FF1. Thus output N of flip-flop FF1 rises up to high level "1", which is applied to the set terminal of flip-flop FF2 through "and" element AND1. Flip-flop FF2 is set and supplies out R of high level "1" and transistor Tr turns ON to energize the solenoid PRLC through relay coil Ry and its contact Rc. Therefore the motor lever 38 rotates in counterclockwise direction and motor pulley 31 is driven to rotate by clutch motor 43, then the sewing needles are actuated and upper threads moves toward the needles. The magnet gears $2_1$ through $2_n$ rotates in response to the movement of the threads, by which outputs $3_1$ through $3_n$ of flux sensors $3_1$ through $3_n$ oscillate and multivibrators generate pulses, which in turn applied to integrating circuits $IC_1$ through $IC_n$ through "or" elements $8_1$ through $8_n$. After a delay time, outputs F1 through $F_n$ of integrating circuits $IC_1$ through $IC_n$ exceeds over the reference voltage and outputs $G_1$ through $G_n$ of comparators COM1 through COMn rise up to high level "1". Thus output I of "and" element 10 rises up to high level "1". There is a delay time Td between the pulse $K_1$ and the rising up of the output I of "and" element 10. The delay circuit 19 has the delay time Td and supplies out 0 of high level "1" which delays by Td from the output N of high level "1" of flip-flop FF1. Outputs S and Q of "and" elements AND2 and AND3 are low level "0" during the delay time Td due to low level "0" of the output 0 of delay circuit 19, and also low level "0" after the delay time Td due to high level "1" of the outputs N and I flip-flop FF1 and "and" element 10 respectively. Therefore flip-flop FF2 is not reset during the delay time Td. Assuming that a thread e.g. the upper thread 25 is broken and the magnet gear $2_1$ stops the rotation, output $B_1$ of flux sensor $3_1$ becomes flat and smooth and multivibrator $7_1$ stops the generation of pulses. Then output $F_1$ of integrating circuit $IC_1$ falls below the reference voltage and output $G_1$ of comparator COM1 falls to low level "0". Therefore output I of "and" element 10 falls to low level "0". The multivibrator 17 generates a pulse J at the decrease of the signal I and output S of "and" element AND3 rises up to high level "1". Thus flip-flop FF1 is reset by the pulse J and flip-flop FF2 is reset by the output S through "or" element OR2. Then the output of amplifier AMP falls to low level "0" to turn transistor Tr OFF. Relay coil Ry is deenergized and contact $R_c$ opens. Therefore solenoid PRLC is deenergized and the motor pulley 31 is separated from clutch motor 43. Thus the sewing machine stops the sewing operation.

The flip-flop FF1 and FF2 are set and the sewing machine starts the sewing operation by closing contact 13 again in a moment ($K_2$, start 2 in FIG. 4). Assuming that a thread which drives magnet gear $3_2$ is tangled, the rotational speed of magnet gear $3_2$ become slow and output $F_2$ of integrating circuit $IC_2$ falls below the reference voltage. Therefore outputs $G_2$ and I of comparator COM2 and "and" element 10 respectively falls to low level "0". Therefore flip-flops FF1 and FF2 are reset and the sewing machine stops the sewing operation.

Assuming that one or more threads are not at the groove of the thread tension disk units and contact 13 is closed in a moment (start 3 in FIG. 4), flip-flops FF1 and FF2 are set and the sewing machine starts the sewing operation. However, flip-flops FF1 and FF2 are reset and the sewing machine stops sewing after the delay time Td, because one or more outputs of the comparators do not rise up to high level "1" even after the delay time Td, and output S rises up to high level "1" after the delay time Td and resets flip-flop FF2 through "or" element OR2.

Assuming that contact 13 was closed again in a moment (start 4 in FIG. 4), flip-flops FF1 and FF2 were set and also the sewing machine is operating, the flip-flop FF1 and FF2 are reset and the sewing machine stops the sewing operation when contact 15 is closed in a moment. Because shaping circuit 16 generates a pulse L in response to the closure of contact 15 and the pulse L resets flip-flop FF1 through "or" element OR1. Output N of flip-flop FF1 falls to low lever "0" in response to the pulse (L). However output 0 of delay circuit 19 remains high level "1" during the delay time Td. Thus output Q of "and" element AND2 is high level "1" during the delay time Td after the pulse L. The flip-flop FF2 is reset at rising up of output Q of "and" element AND2. When contact 11 is opened in a moment at the set condition of flip-flop FF1 and FF2, output I of "and" element 10 falls to low level "0" in response to a negative pulse H from shaping circuit 12, and multivibrator 17 and "and" element AND3 generate pulses J, S which reset flip-flop FF1 and FF2 through "or" element OR1 and OR2 respectively.

Signal $A_1$ rises up to high level "1" by disconnecting plug $4_1$ from socket $5_1$. In which case a voltage of high level "1" is applied to integrating circuit $IC_1$ through "or" element $8_1$ continually. Thus output $G_1$ is high level "1" continually. Assuming that the plug $4_1$ is disconnected from the socket $5_1$ and contact 13 is closed in a moment (start 5 in FIG. 4), output I of "and" element 10 is determined by the outputs $G_2$ through $G_n$. This means that converter $1_1$ and the speed meter circuit ($5_1$ through $COM_1$) corresponding to converter $1_1$ have no effect on the operation of the electric logic circuit (10 through AMP). Likewise, any one of the converters and the speed meter circuit corresponding to it may be disabled with respect to the stop control operation of the electric logic circuit by disconnecting the plug of the converter from the socket corresponding to the plug. Therefore the system shown in FIG. 1 is applicable for supervising the movement of one or more threads.

The sewing machine shown in FIG. 2 has the pedal 33 linked to the motor lever 38. Therefore start and stop operations of the sewing machine can be controlled by the pedal 33. Therefore, the operator can operate the sewing machine by depressing the pedal when the upper thread 25 is broken or the winding of a lower thread on the bobbin 63 is required.

Figure 5:
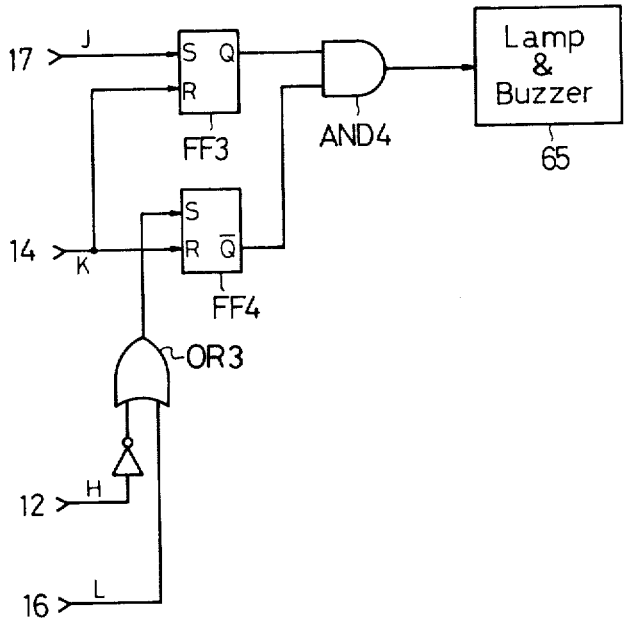
FIG. 5 shows an alarm circuit which may be combined with the system shown in FIG. 1.

It is preferable to provide the system with an alarm circuit to warn the operator when the system automatically stops the sewing machine. FIG. 5 shows an example of the alarm circuit. In FIG. 5, a flip-flop FF3 is set by the output J of multivibrator 17; a flip-flop FF4 is set by an output of an "or" element OR3; flip-flop FF3 and FF4 are reset by the output K of shaping circuit 14; a reversed output ($\overline{H}$) of shaping circuit 12 is applied to a input terminal of "or" element OR3 through an inverter; the output L of shaping circuit 15 is applied to the other input terminal of "or" element OR3; outputs at Q and $\overline{Q}$ terminals of flip-flop FF3 and FF4 respectively are applied to an "and" element AND4; and an output of "and" element AND4 is applied to a lamp and buzzer device 65. Flip-flops FF3 and FF4 are reset at the closure of contact 13. Thus outputs at Q and $\overline{Q}$ terminals of flip-flops FF3 and FF4 are low level "0" and high level "1" respectively. The output of "and" element AND4 is low level "0". When a trouble of a thread is detected by any one of the speed meter circuits and multivibrator 17 generates a pulse, flip-flop FF3 is set and the output of "and" element AND4 rises up to high level "1", which energizes lamp and buzzer device 65. At normal stop control of the sewing machine by the use of contact 11 or 15, a pulse from shaping circuit 12 or 16 sets flip-flop FF4 through "or" element OR3. Thus the output of "and" element AND4 does not rise up to high level "1" even if flip-flop FF3 is setted by the output pulse of multivibrator 17.

As described above, the drive control system of the invention detects the break and tangle of threads, the tangle of the cloth, the accidental skip of the sewing stitches and the consumption of the upper or lower thread through supervising the rotational speed of the thread tension disk units and stops the sewing machine automatically when a trouble of a thread is detected. An extension of the trouble is prevented, especially, on a high speed sewing machine. The detection of the rotational speed is accurate because the flux sensors detects the teeth of magnet gears and the pitch of the teeth is small. The detection of the thread trouble is accurate as compared with the detection by the use of micro-switches or photo-sensors.

It will be understood that those skilled in the art may make changes and modifications to the foregoing drive control system for a sewing machine. For example, the "or" elements $8_1$ through $8_n$ may be connected between the comparators $COM_1$ through $COM_n$ and the "and" element 10; the "and" and "or" elements may be another logical elements by reversing the polarity of the signals; the link mechanism between the motor lever 38 and the pedal may be eliminated by arranging the start and stop switches 13 and 15 at the positions at which they are operated by the pedal 33; and the motor lever 38 and solenoid PRLC may be eliminated by employing an electromagnetic clutch in the sewing machine and energizing it in response to the energization of the relay coil Ry.

What is claimed is:

1. A drive control system for a sewing machine comprises:

at least a converter which is coupled with a thread tension disk unit of the sewing machine and generates an oscillating electric signal in response to a rotation of the thread tension disk unit;

at least a shaping circuit which is connected to the converter and shapes the oscillating electric signal into a train of pulses, at least a level detection circuit having an integrating circuit which integrates the train of pulses and a comparator which compares the integrated voltage level with a predetermined voltage level and detects a decrease in the rotational speed of the thread tension disk unit; and an electric logic circuit which is energized to generate a drive indication signal in response to a start indication signal and deenergized to disappear the drive indication signal in response to a stop indication signal and the detection of the decrease of the rotational speed by the level detection circuit.

2. A drive control system for a sewing machine as set forth in claim 1 wherein the converter has a magnet gear and a flux sensor.

3. A drive control system for a sewing machine as set forth in claim 1 wherein the system further comprises an alarm circuit which is energized in response to the detection of the falling down of the rotational speed.

4. A drive control system for a sewing machine as set forth in claim 1 wherein the electric logic circuit has a first logical circuit which is energized in response to the start indication signal to generate a basic drive indication signal and deenergized in response to the stop indication signal, a delay circuit generating a delayed signal having a delay time with respect to the basic drive indication signal, and a second logical circuit which is energized in response to the basic drive indication signal to generate another drive indication signal suitable for actual drive control of the sewing machine and deenergized in response to the detection of a decrease in the rotational speed.

5. A drive control system for a sewing machine comprises:

a pluarlity of shaping circuits each one of which has socket terminals to be engaged with the plug terminals connected to one of the converters and shapes the oscillating electric signal into a train of pulses;

a pluarlity of level detection circuits each one of which has an integrating circuit which integrates the train of pulses and a comparator which compares the integrated voltage level with a predetermined voltage level and detects a decrease in the rotational speed of the thread tension disk unit;

a plurality of circuit elements each one of which, in response to disk connection of the socket terminals from the plug terminals, disables the generation of the detection signal in the level detection circuit; and an electric logic circuit which is energized to generate a drive indication signal in response to a start indication signal and deenergized to disappear the drive indication signal in response to a stop indication signal and a detection signal from any one of the level detection circuits.

6. A drive control system for a sewing machine as set forth in claim 5 wherein the system further comprises an alarm circuit which is energized in response to the detection signal.

* * * * *